United States Patent [19]

Kobayashi et al.

[11] Patent Number: 4,883,158

[45] Date of Patent: Nov. 28, 1989

[54] DEVICE AND METHOD FOR MANAGING AMOUNT OF STORED COINS

[75] Inventors: Osamu Kobayashi, Iruma; Yonezou Furuya, Hiki; Takeshi Isida, Sakado; Mitsugu Mikami, Kawagoe, all of Japan

[73] Assignee: Kabushiki Kaisha Nippon Coinco, Tokyo, Japan

[21] Appl. No.: 171,688

[22] Filed: Mar. 22, 1988

[30] Foreign Application Priority Data

Mar. 24, 1987 [JP] Japan ..... 62-67985

[51] Int. Cl.[4] ..... G07D 3/16

[52] U.S. Cl. ..... 194/217; 194/317; 453/17

[58] Field of Search ..... 194/217, 218, 317, 318; 453/17

[56] References Cited

U.S. PATENT DOCUMENTS 4,286,703 9/1981 Schuller et al. ..... 194/317

4,491,140 1/1985 Eglise et al. ..... 194/217 X

*Primary Examiner*—F. J. Bartuska

*Attorney, Agent, or Firm*—Spensley Horn Jubas & Lubitz

[57] ABSTRACT

Deposited coins are stored in a coin storing device and change is paid out of coins storred in this storing device. For detecting an amount of coins going in and out of the coin storing device, a going-in-and-out detector is provided. For setting an initial amount P of stored coins in the coin storing device, an initial stored coin amount setter is provided. In an operation device, an operation for obtaining difference N between a current amount S of stored coins and the initial amount P in accordance with the output of the going-in-and-out detector and the initial amount P. When the amount of stored coins in the coin storing device is to coincide with the initial amount P (e.g., when an inventory operation is to be performed), a command device commands this. In response to this command, a payout control device performs, if the current amount S is larger than the initial amount P, control for paying out the number of coins corresponding to the difference N. Thus, if the current amount S of stored coins is larger than the initial amount P, a superfluous coin is automatically paid out so that the amount of stored coins is caused to coincide with the initial amount P. Conversely, if the current amount S of stored coins in the coin storing device is smaller than the initial amount P, a display control device displays that the amount of stored coins is short. The operator may additionally deposit deficient coins upon finding the deficiency whereupon the amount of stored coins is caused to coincide with a predetermined initial stored coin amount P.

20 Claims, 11 Drawing Sheets

DEVICE AND METHOD FOR MANAGING AMOUNT OF STORED COINS

BACKGROUND OF THE INVENTION

This invention relates to a coin mechanism used for vending machines or exchangers and, more particularly, to a device and method for managing amount of coins stored in a coin storing device provided in such coin mechanism.

Further, this invention relates to a sales management device performing sales management on the basis of the amount of coins stored in the coin storing device and also the amount of coins in a coin box receiving coins which have overflown from the coin storing device.

In a coin mechanism in a vending machine, there is generally provided a coin storing device called a coin tube. A deposited coin is supplemented to coins stored in this coin tube and a coin or coins among the coins stored in the coin tube are paid out as change or money to be returned. When the amount of stored coins has reached a full state, a coin which overflows from the coin tube is guided to a coin box. In managing the amount of stored coins in such coin tube, it has been a general practice that an operator such as a route man takes out all coins in the coin tube by depressing an inventory switch to collect these coins as the amount of sales and then he supplements a suitable amount of coins to the coin tube by manual operation. Since, in this case, the amount of coins manually supplemented constitutes the base of calculation of next amount of sales, it is very important to check how many coins have been manually supplemented. For this reason, it has been a general practice to have the number of coins counted by the operator while he is manually supplementing coins or to supplement coins manually until the coin tube becomes full and regard this full state to be the amount of coins manually supplemented.

The former method, i.e., supplementing coins while counting the number of coins one by one, is very troublesome and tends to cause mistakes. The latter method is also inconvenient in managing because there are difference in the size between coin tubes and also difference in thickness between coins so that the number of coins at a full amount of one coin tube is not necessarily the same as that of another coin tube.

Further, since it is not possible in the prior art devices to detect, by denomination, coins which have overflown from a coin tube and have been guided to a coin box, it is not possible to conduct management such as summing of the current amount of coins and displaying thereof in the coin tube and summing of the current amount of coins and displaying thereof in the coin box.

SUMMARY OF THE INVENTION

It is, therefore, an object of the invention to provide a device and method for managing amount of stored coins enabling an operator to store a predetermined amount of coins to be stored initially in a coin storing device in a simple and easy manner when he collects and supplements stored coins.

It is also an object of the invention to provide a sales management device capable of readily performing management of current amounts of coins by denomination in the coin tube and coin box.

A device for managing amount of stored coins made according to the invention comprises a coin storing device for storing coins having deposited coins supplemented to stored coins and having a coin or coins among the stored coins paired out for change or other purpose; initial stored coin amount setting means for setting an initial amount of stored coins in said coin storing device; going-in-and-out detection means for detecting an amount of coins going in and out of said coin storing device; operation means for obtaining difference between a current amount of stored coins in said coin storing device and the initial amount of stored coins in accordance with the output of said going-in-and-out detection means and the initial amount of stored coins; command means for commanding a processing for causing the amount of stored coins in said coin storing device to coincide with the initial amount of stored coins; payout control means responsive to the command issued by said command means for paying out, if the current amount of stored coins in said coin storing device is larger than the initial amount of stored coins, coins of the number corresponding to the difference obtained by said operation means; and display control means responsive to the command issued by said command means and the difference obtained by said operation means for displaying, if the current amount of stored coins in said coin storing device is smaller than the initial amount of stored coins, the fact that the amount of stored coins is deficient.

An initial amount P of stored coins in the coin storing device is set by the initial stored coin amount setting means. This initial amount P of stored coins can be set as desired by an operator. An amount of coins going in and out of the coin storing device is detected by the going-in-and-out detection means. A current amount of stored coins in the coin storing device is detected from difference between the number of coins which have entered the coin storing device and the number of coins which have come out of the coin storing device. The operation means performs, in accordance with the output of the going-in-and-out detection means and the initial amount P of stored coins set by the setting means, an operation for obtaining difference N between the current amount S of stored coins and the initial amount P of stored coins. When a processing for causing the amount of stored coins in the coin storing device to coincide with the initial amount P (e.g., when the inventory operation is to be made), this processing is commanded by the command means. Responsive to this command, the payout control means performs control so that, if the current amount S in the coin storing device is larger than the initial amount P, the number of coins corresponding to the difference N is paid out of the coin storing device. Thus, if the current amount S is larger than the initial amount P, a superfluous coin is automatically paid out with a result that the amount of stored coins is caused to coincide with the initial amount P. Conversely, if the current amount S in the coin storing device is smaller than the initial amount P, the display control means displays that the amount of stored coins is deficient. The operator may additionally deposit the deficient amount of coins upon finding this display of deficiency, whereupon the amount of stored coins is caused to coincide with the predetermined initial stored coin amount P.

By paying out, as described above, superfluous coins automatically if the current amount S is larger than the initial amount P and displaying that the amount of stored coins is deficient if the current amount S is smaller than the initial amount P, the processing for storing the predetermined initial amount of stored coins in the coin storing device can be achieved in a simple and easy manner. This facilitates the management for controlling the amount of stored coins at a starting point of management such as sales management to always become the initial amount P and thereby facilitates subsequent inventories of the amount of stored coins and amount of sales.

In another aspect of the invention, the initial stored coin amount setting means may be omitted. That is, by initially setting ( i.e.,initially storing) a desired initial amount of stored coins actually in the coin storing device, it is unnecessary to particularly set and memorize the initial amount of stored coins as data.

The method for managing amount of stored coins according to the invention comprises a first step for initially setting a predetermined initial amount of stored coins in a coin storing device; a second step for detecting an amount of coins going in and out of said coin storing device; a third step for obtaining difference between a current amount of stored coins in said coin storing device and the initial amount of stored coins in accordance with result of detection in said second step; a fourth step for paying out, if the current amount of stored coins in said coin storing device is larger than the initial amount of stored coins, the number of coins corresponding to the difference obtained in said third step from said coin storing device thereby to cause the current amount of stored coins to coincide with the initial amount of stored coins; a fifth step for displaying, if the current amount of stored coins in said coin storing device is smaller than the initial amount of stored coins, that the amount of stored coins is deficient in accordance with the difference obtained in said third step; and a sixth step for causing the current amount of stored coins to coincide with the initial amount of stored coins by supplementing the amount of coins which is deficient to said coin storing device in accordance with the display made in said fifth step.

Further, the sales managing device according to the invention comprises a coin storing device for storing coins having deposited coins supplemented to stored coins and having a coin or coins among the stored coins paid out for change or other purpose; a coin box receiving coins which have overflown from said coin storing device; deposited coin detection means for counting and memorizing deposited coins by denomination; paid-out coin detection means for counting and memorizing coins which have been paid out of said coin storing device by denomination; overflowing coin detection means for counting and memorizing, by denomination, coins which have overflown from said coin storing device and received in said coin box; and operation means for calculating the amount of stored coins in said coin storing device by denomination in response to outputs of said deposited coin detection means, said paid-out coin detection means and said overflowing coin detection means, the amount of stored coins in said coin storing device being detected by denomination by the output of said operation means and the current amount of coins received in said coin box being detected by denomination by the output of said overflowing coin detection means.

According to the sales managing device of the invention, the overflowing coin detection means is provided for counting and memorizing coins which have overflown from the coin storing device and received in the coin box by denomination so that the coins received in the coin box can be detected by denomination. Accordingly, not only the amount of stored coins in the coin storing device but also the amount of coins which have overflown from the coin storing device and received in the coin box are detected by denomination so that a total amount of coins, i.e., amount of sales, can be detected by these two amounts. Further, since the amount of coins received can be detected by denomination instantly, sales management is facilitated.

An embodiment of the invention will now be described with reference to the accompanying drawings.

BRIEF DESCRIPTION OF THE DRAWINGS

In the accompanying drawings.

DESCRIPTION OF PREFERRED EMBODIMENT

Figure 1:
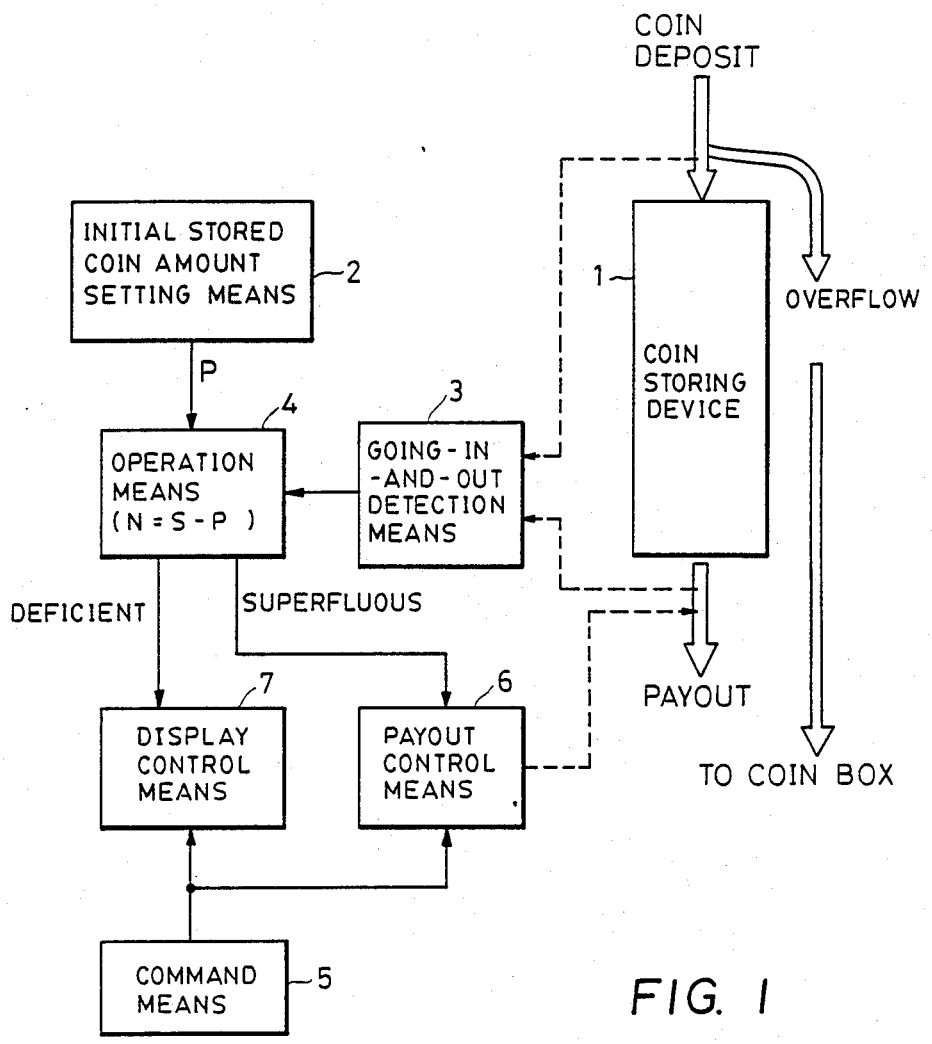
FIG. 1 is a functional block diagram showing an embodiment of the invention.

In FIG. 1, a coin storing device 1 stores coins. Deposited coins are supplemented to stored coins and a coin or coins among the stored coins are paid out for change or other purpose. Initial stored coin amount setting means 2 is provided for setting an initial amount P of stored coins in the coin storing device 1. This initial amount P can be set as desired by an operator. An amount of coins going in and out of the coin storing device 1 is detected by going-in-and-out detection means 3. Operation means 4 performs operation for obtaining difference N between a current amount S of stored coins and the initial amount P in accordance with the output of the going-in-and-out detection means 3 and the initial amount P. Command means 5 issues a command for performing a processing for causing the amount of stored coins in the coin storing device 1 to coincide with the initial amount P. When the amount of stored coins in the coin storing device 1 is to coincide with the initial amount P (e.g., when an inventory operation is to be performed), the command means 5 issues this command. In response to this command, payout control means 6 performs, if the current amount S is larger than the initial amount P, control for paying out the number of coins corresponding to the difference N. Thus, if the current amount S of stored coins is larger than the initial amount P, a superfluous coin is automatically paid out so that the amount of stored coins is caused to coincide with the initial amount P. Conversely, if the current amount S of stored coins in the coin storing device 1 is smaller than the initial amount P, display control means 7 displays that the amount of stored coins is deficient. The operator may additionally deposit deficient coins upon finding the deficiency whereupon the amount of stored coins is caused to coincide with a predetermined initial stored coin amount P.

By performing, as described above, the processing for paying out a superfluous coin automatically if the current amount S is larger than the initial amount P and displaying the deficiency of coins if the current amount S is smaller than the initial amount P, a processing for storing coins of a predetermined initial amount can be achieved in a simple and easy manner. As a result, the amount of stored coins at a starting point of management such as a sales management can be readily controlled so that the amount will always become the initial amount P. This facilitates subsequent inventory of stored coins and sales management.

A specific embodiment of the invention will now be described with reference to FIGS. 2 through 19.

Figure 2:
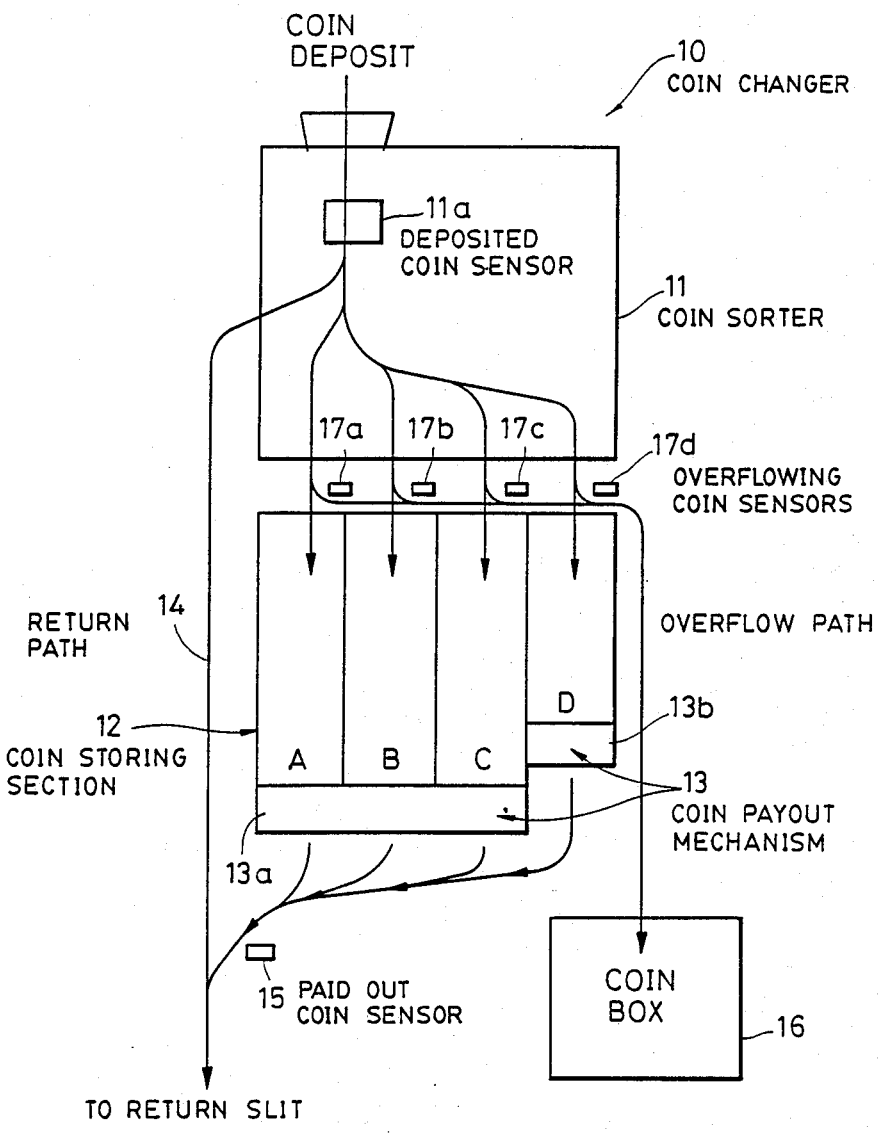
FIG. 2 is a schematic view of a mechanical structure of a coin changer to which a more specific embodiment of the stored coin amount managing device according to the invention has been applied.
Figure 3:
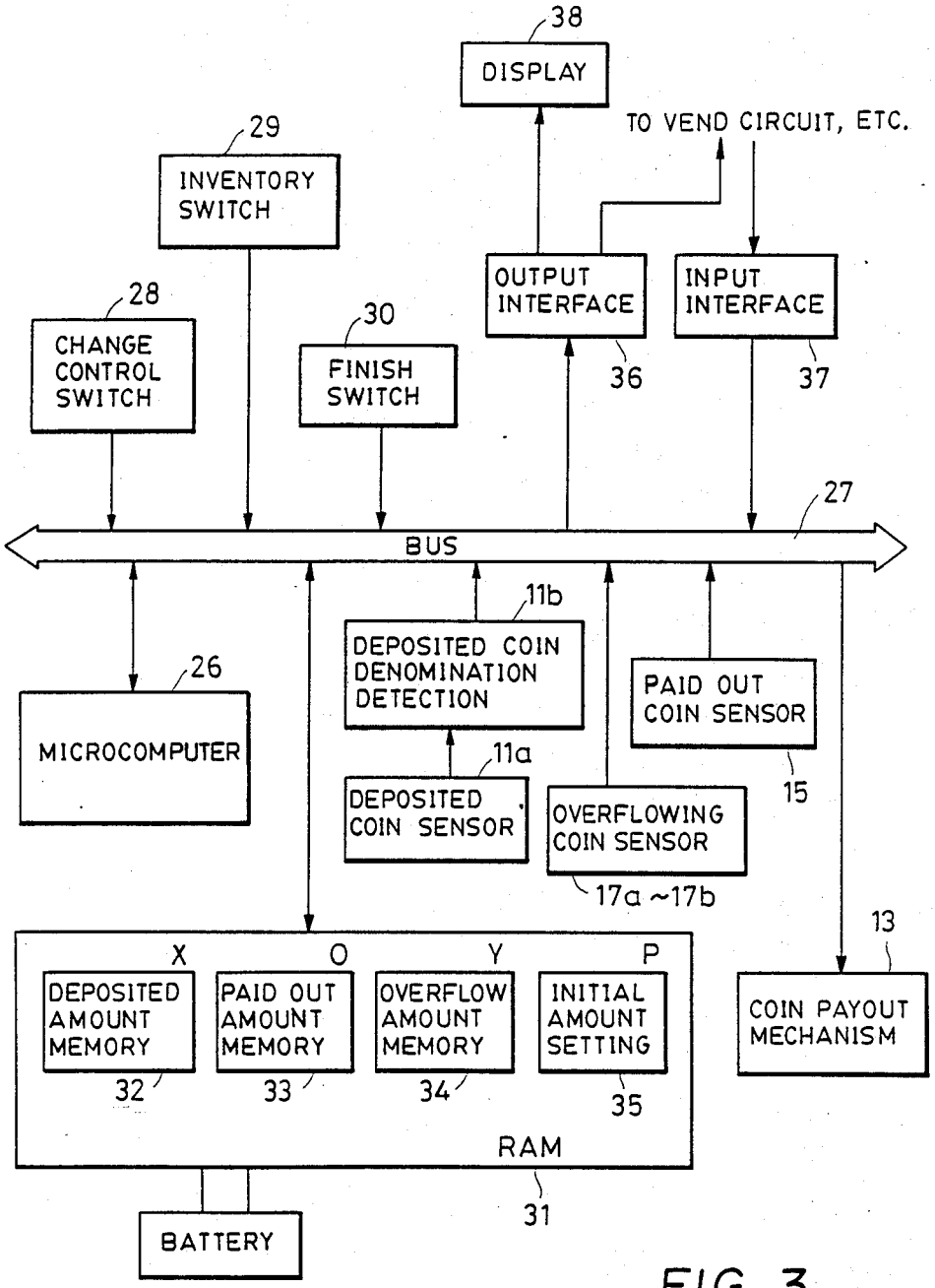
FIG. 3 is a block diagram showing a hardware structure of a control circuit device mounted on the coin changer.

FIG. 2 is a schematic diagram showing an example of a mechanical structure of a coin changer 10 incorporating the specific embodiment of the invention and FIG. 3 is a block diagram of hardware structure of an example of a control circuit device mounted on this coin changer 10. The coin changer 10 generally comprises a coin sorter 11, a coin storing section 12, a coin payout mechanism 13 and a control circuit device as shown in FIG. 3. The coin sorter 11 discriminates a true coin from a false one, sorts out the true coin and false one automatically, leads the false coin to a return path 14 and sorts out true coins by denomination. The coin storing section 12 comprises coin tubes A, B and C for respective denominations and a coin retaining section D. Coins for the respective denominations sorted out by the coin sorter 11 are stored in the corresponding coin tubes A, B and C and the coin retaining section D. The coin tubes A, B and C store coins in a stacked state so that a relatively large number of coins can be stored in each coin tube. The coin retaining section D stores coins in such a manner that they are all disposed in an erected state and one coin is placed at its peripheral edge upon the peripheral edge of another coin so that only a relatively small number of coins can be stored. For example, the coin tube A corresponds to 10-yen coins, the coin tube B to 50-yen coins, the coin tube C to 100-yen coins and the coin retaining section D to 500-yen coins. The coin payout mechanism 13 comprises a payout slide mechanism 13*a* for paying out a coin selectively from one of the coin tubes A, B and C and a payout mechanism 13*b* for paying out a coin from the coin retaining section D.

The coin sorter 11 may comprise a deposited coin sensor 11*a* of an electronic type. This coin sensor 11*a* has a function of electronically discriminating a true coin from a false one among deposited coins. In the coin sorter 11, a false coin and a true coin are sorted out in accordance with this discrimination. Further, denomination of a deposited coin is detected in response to the output of the coin sensor 11*a* and thereupon a deposited coin detection signal for each denomination is produced. Instead of this construction for producing a deposited coin detection signal by denomination in response to the output of the electronic deposited coin sensor 11*a*, a deposited-coin-by-denomination sensor (not shown) may be provided besides the deposited coin sensor 11*a* for detecting a coin led from the coin sorter 11 to the coin storing section 12 by denomination and thereupon producing a deposited coin detection signal. Further, if necessary, a paid out coin sensor 15 may be provided for detecting a coin paid out by the coin payout mechanism 13. Coin sensors ( such as coin sensor 15 and other coin sensors 17*a*–17*d* to be described later) other than the electronic deposited coin sensor 11*a* may be ones which have an only function of detecting passing of a coin.

The above described construction of the coin changer 10 is known. Accordingly, the construction of the coin changer 10 is not limited to the above described one but other equivalent or similar construction may be employed according to necessity.

A novel feature in the embodiment of FIG. 2 is provision of overflowing coin sensors 17*a* through 17*d* which detect, by denomination, coins which have overflown from the coin tubes A, B and C and the coin retaining section D and are received in a coin box 16. Deposited coins are sorted out by the coin sorter 11 and led to the coin storing section 12 once so as to be stored in the coin storing section 12. If, however, coins are full in the coin storing section 12, a newly deposited coin overflows and is led to the coin box 16. For detecting such overflowing coin, the overflowing coin sensors 17*a*–17*d* are provided.

Figure 4:
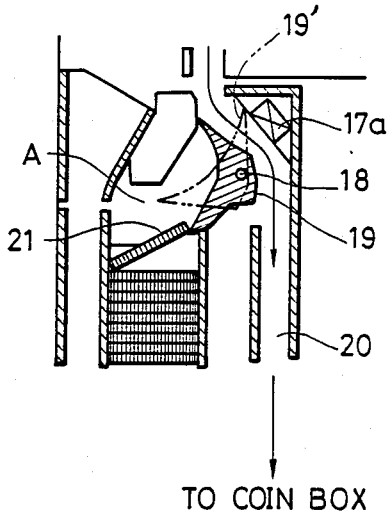
FIG. 4 is a sectional view showing an example of mounting a sensor detecting an overflowing coin from the coin tube in FIG. 2.

FIG. 4 is a sectional view showing an example of mounting of the overflowing coin sensor 17*a* corresponding to the coin tube A. When coins stored in the coin tube A are not full, a distributing block 19 which is pivotable about a pin 18 is located at a position shown by a chain-and-dot line 19' thereby closing a passage 20 communicating with the coin box 16 and leading a deposited coin to the coin tube A. When the coins stored in the coin tube A are full, the distributing block 19 is locked by the coin of the uppermost layer as shown in the figure thereby opening the passage 20 to the coin box 16 and causing a deposited coin to be received in the coin box 16 passing through the passage 20. The overflowing coin sensor 17*a* is provided at the entrance of the passage 20 and consists, for example, of a proximity switch made of, e.g. a coil. The other overflowing coin sensors 17*b* and 17*c* corresponding to the other coin tubes B and C may be mounted in a similar way.

Figure 5:
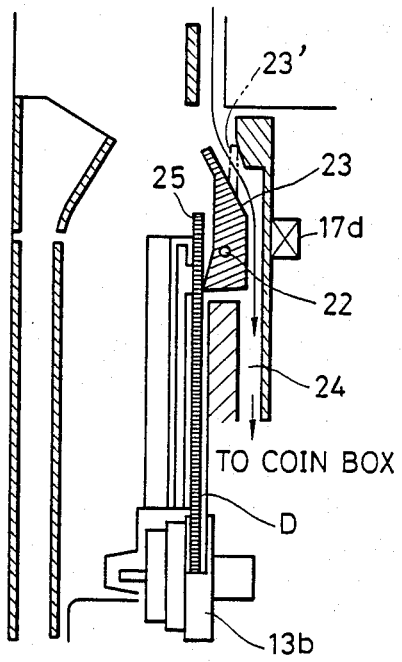
FIG. 5 is a sectional view showing an example of mounting a sensor detecting an overflowing coin from the coin retaining section in FIG. 2.

FIG. 5 is a sectional view showing an example of mounting of the overflowing coin sensor 17*d* corresponding to the coin retaining section D. When the coins stored in the coin retaining section D are not full, a distributing block 23 which is pivotable about a pin 22 is located at a position shown by a chain-and-dot line 23' thereby closing a passage 24 communicating with the coin box 16 and leading a deposited coin to the coin retaining section D. When the coins stored in the coin retaining section D are full, the distributing block 23 is locked by an uppermost coin 25 as shown in the figure thereby opening the passage 24 communicating with the coin box 16 and causing a deposited coin to be received in the coin box 16 passing through the passage 24. The overflowing coin sensor 17*d* is provided at the entrance of the passage 24 and consists of a proximity switch made of, e.g., a coil.

An example of a control circuit device will now be described with reference to FIG. 3. Various processings by this control circuit device are controlled by a microcomputer 26. The output of the deposited coin sensor 11*a* is applied to a deposited coin denomination detection circuit 11*b* and a deposited coin detection signal corresponding to the denomination of the deposited coin is produced by the detection circuit 11*b*. Outputs of the deposited coin denomination detection circuit 11*b*, paid out coin sensor 15 and overflowing coin sensors 17*a*–17*d* are applied to the microcomputer 26 through a bus 27. A coin payout command signal is supplied to the coin payout mechanism 13 through the bus 27.

A change control mode switch 28 is a switch which is operated in a mode in which the amount of stored coins in the coin storing section 12 is controlled according to the invention (hereinafter referred to as "change control mode").

An inventory switch 29 is a switch which is operated for automatically paying out a superfluous coin among the stored coins or displaying the deficiency in the stored coins in the change control mode.

A finish switch 30 is a switch operated by the operator when the change control mode is to be finished. In this embodiment, a return switch operated by a customer when a deposited coin or change is to be returned is used concurrently as the finish switch 30.

A battery-backed up RAM 31 stores various data such as sales amount calculated by the microcomputer 26. Examples of memories included in this RAM 31 are deposited amount memory 32 storing a total number of deposited coins by denomination, paid out amount memory 33 storing a total number of coins paid out of the coin storing section 12 by denomination, overflow amount memory 34 storing a total number of coins overflowing from the coin storing section 12 and being received in the coin box 16 by denomination and initial amount setting data memory 35 storing an initial amount of stored coins in the coin string section 12.

An output interface 36 is provided for transmitting display data, vend enable signal and other data to a money amount display 38 and a vend circuit (not shown).

An input interface 37 is provided for receiving an article selection signal and other data from the vend circuit or other circuits.

Next, an example of processings executed under the control of the microcomputer 26 will be described with reference to the flow charts of FIG. 6 and subsequent figures.

Figure 6:
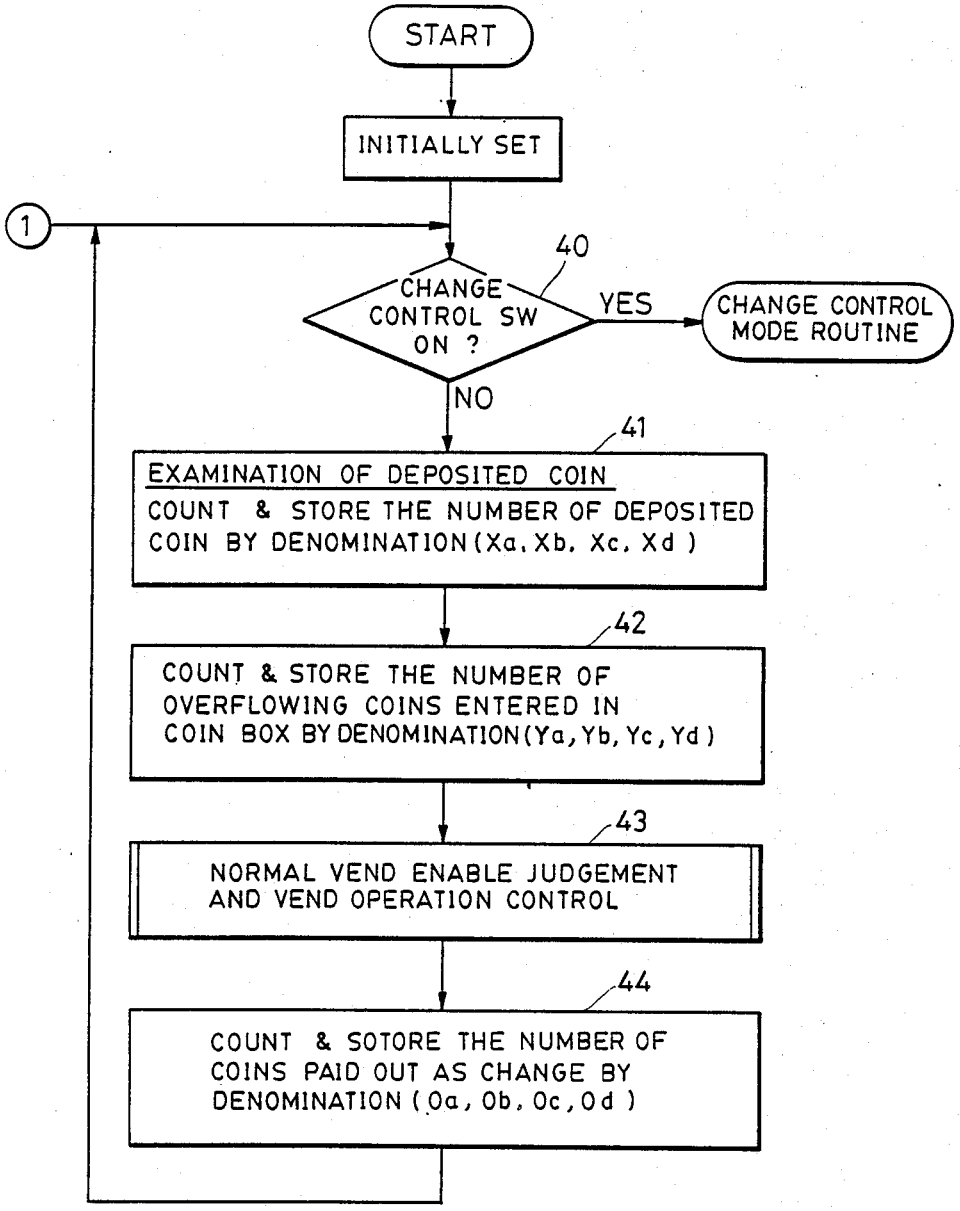
FIGS. 6 through 19 are flow charts showing an example of processings executed by the microcomputer in FIG. 3.
Figure 7:
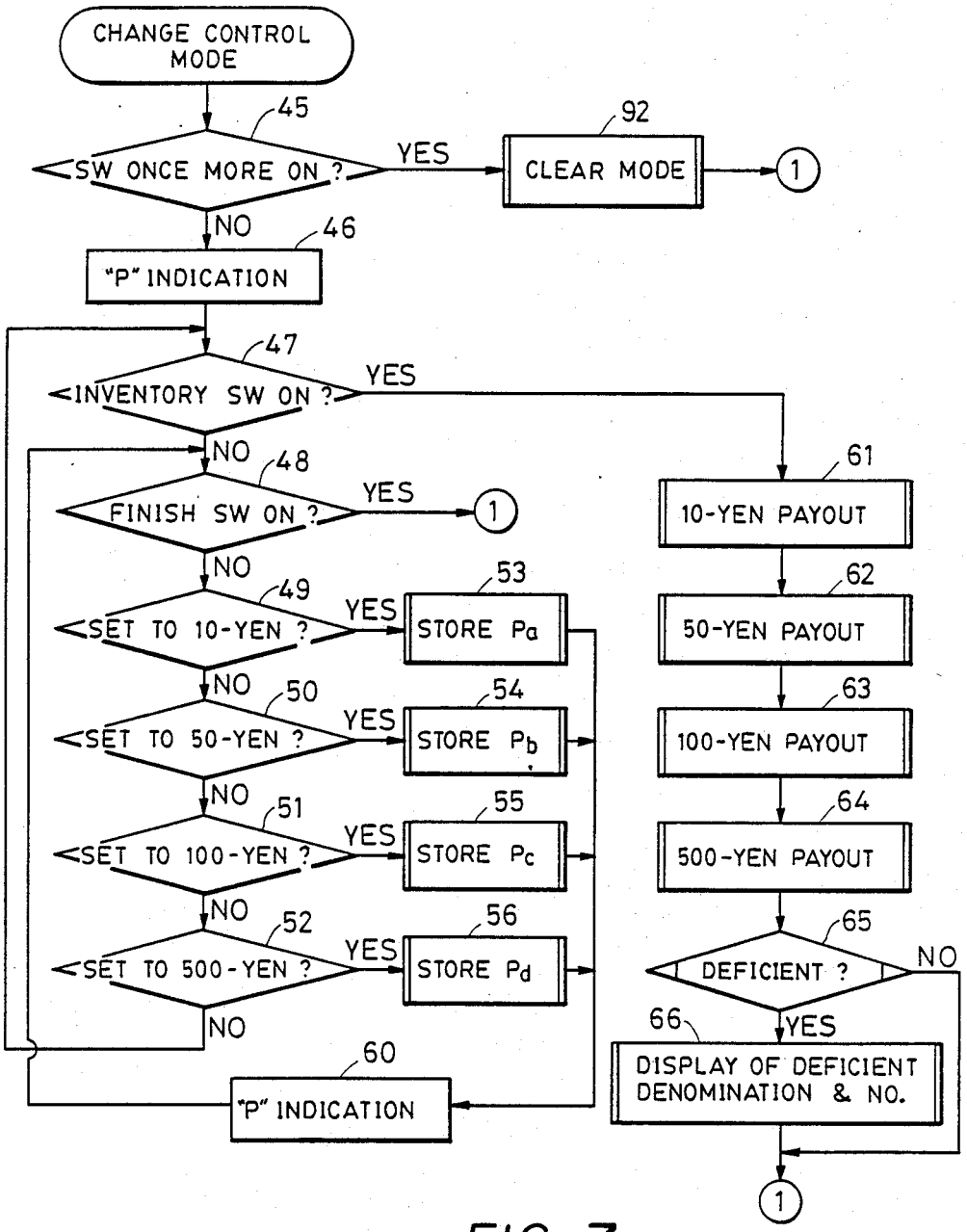

FIG. 6 shows a main routine. Upon starting by turning of a power switch, states of various circuits are initially set and thereafter whether the change control switch 28 is ON or not is examined (step 40). If result is NO, a routine consisting of steps 41, 42, 43 and 44 is executed and the processing returns to step 40. If step 40 is YES, a change control mode routine shown in FIG. 7 is executed.

When the procesings for managing amount of stored coins according to the invention are executed, the operator depresses the change control mode switch 28 once. Thereupon judgement of YES is made in step 40 and the change control mode routine of FIG. 7 is executed. In the change control mode, there are a mode for setting the initial amount P, an inventory mode for automatically paying out a superfluous coin among the stored coins or displaying deficiency in the stored coins and a clear mode for clearing the set initial amount P.

THE MODE FOR SETTING THE INITIAL AMOUNT P

The mode for setting the initial amount P of stored coins is selected by depressing the change control mode switch 28 once. In FIG. 7, in step 45, whether or not the change control switch 28 has been depressed once more is examined. If the switch 28 has been depressed only once, step 45 is NO and the processing proceeds to step 46 in which the letter "P" is indicated by the display 38. The operator confirms the "P" indication in the display 38 and thereupon selects either the mode for setting the initial amount P or the inventory mode. If the inventory switch 29 is not depressed in this state, the mode for setting the initial amount P is introduced whereas if the inventory switch 29 is depressed, the inventory mode is introduced. In step 47, whether or not the inventory switch 29 has been depressed is examined. If result is NO, the processing proceeds to step 48. In step 48, whether or not the finish switch 30 is ON is examined. If result is NO, the processing proceeds to step 49.

In steps 49–56, processings for setting the initial amount P by denomination are executed. In steps 49–52, whether or not the initial amount P should be set with respect to 10-yen, 50-yen, 100-yen and 500-yen respectively. If these steps 49–52 are YES, the processing proceeds to corresponding steps 53–56 in which data of initial amounts Pa–Pd set by the operator in correspondence to these denominations are stored in the initial amount setting data memory 35 in the RAM 31. Pa represents the initial amount set in correspondence to the 10-yen denomination, Pb the 50-yen denomination, Pc the 100-yen denomination and Pd the 500-yen denomination.

For example, setting of the initial amounts Pa–Pd of the respective denominations is performed by depositing a desired number of coins of each denomination. In this case, the judgement in steps 49–52 is made depending upon whether or not a coin of corresponding denomination has been deposited. If, for example, a 10-yen coin is deposited, step 49 becomes YES and the processing proceeds to step 53. In this case, the processing of step 53 is executed by a subroutine as shown in FIG. 8.

Figure 8:
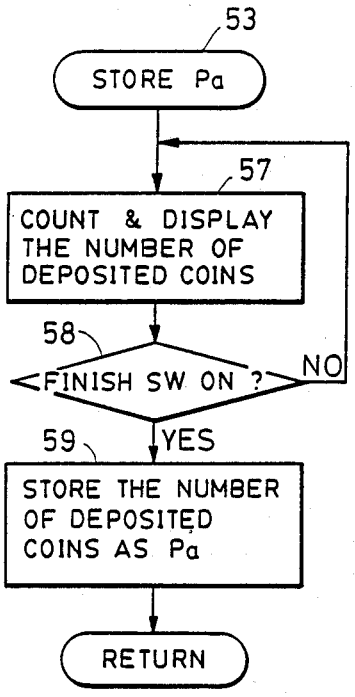

In FIG. 8, in step 57, the number of deposited coins is counted and displayed on the display 38. The operator confirms the number of deposited coins by the indication on the display 38. Upon finishing of deposition of coins of the number corresponding to the desired initial amount Pa, the operator depresses the finish switch 30. Step 58 thereby becomes YES and the processing proceeds to step 59 in which the number of deposited coins is stored as the initial amount Pa in the initial amount setting data memory 35. Steps 54–56 for the other denominations consist of subroutines similar to the one shown in FIG. 8.

By depositing a desired number of coins for each denomination in the foregoing manner, the initial amounts Pa–Pd for the respective denominations are set. Since there are set maximum number of coins which can be stored in the coin tubes A–C and the coin retaining section D for the respective denominations, consideration should be given in the design of the device so that the initial amounts Pa–Pd exceeding the set maximum number of coins cannot be set. Detailed description about such design however will be omitted.

Reverting to FIG. 7, the processing proceeds to step 60 after steps 53–56 and "P" is indicated on the display 38. The processing then returns to step 48.

When setting of the initial amounts Pa–Pd for the respective denominations is to be finished, the operator depresses the finish switch 30 after confirming that "P" is indicated on the display 38. Thereupon, step 48 becomes YES and the processing returns to step 40 in FIG. 6. That is, the processing returns to a stand-by state.

In this embodiment, it is assumed that coins used for setting the initial amounts Pa–Pd are not returned. By this arrangement, coins of the same numbers as the set initial amounts Pa–Pd are prestored in the coin storing section 12. It is also assumed that the numbers of deposited coins used for setting the initial amounts Pa–Pd are memorized in the deposited amount memory 32. These assumptions, however, are limited to the present embodiment only and other design is of course possible.

After setting of the initial amounts Pa–Pd of stored coins in the foregoing manner, a normal working condition is brought about.

NORMAL OPERATION

Referring to FIG. 6, in the standby mode, the judgement of step 40 is constantly made and the routine of steps 41–44 is executed unless the change control mode switch 28 is depressed. In step 41, whether or not a coin has been deposited is examined and, if a coin has been deposited, the number of deposited coins is counted by denomination. The number of deposited coins by denomination is cumulatively counted and stored in the deposited coin amount memory 32 of the RAM 31. The accumulated number of deposited 10-yen coins which is stored in the deposited amount memory 32 is represented by Xa, that of deposited 50-yen coins by Xb, that of deposited 100-yen coins by Xc and that of deposited 500-yen coins by Xd. The accumulation is started at the change control mode and the deposited coin number data Xa–Xd in the deposited amount memory 32 are initially set in the initial amounts Pa–Pd at this time.

In step 42, the number of overflowing coins is cumulatively counted by denomination in response to outputs of the overflowing coin sensors 17*a*–17*d* and the accumulated numbers of deposited coins are stored in the overflow amount memory 34 in the RAM 31. The number of overflowing 10-yen coins stored in the overflow amount memory 34 is represented by Yc, that of overflowing 50-yen coins by Yb, that of overflowing 100-yen coins by Yc and that of overflowing 500-yen coins by Yd. The accumulation is also started at the change control mode.

In step 43, normal vend enable judgement and vend operation control are carried out.

In step 44, the number of coins paid out of the coin storing section 12 as change as a result of the processing in step 43 is cumulatively counted by denomination and stored in the paid-out amount memory 33 of the RAM 31. The number of paid out 10-yen coins stored in the paid-out amount memory 33 is represented by Oa, tat of paid out 50-yen coins by Ob, that of paid out 100-yen coins by Oc and that of paid out 500-yen coins by Od. The accumulation is also started at the change control mode.

INVENTORY MODE

In a case where control of the amount of stored coins is made after operating the vending machine for a desired period of time, the change control mode switch 28 is depressed once and then the inventory switch 29 is depressed. The processing thereupon proceeds to the change control mode routine of FIG. 7 in which step 47 becomes YES and processings of the inventory mode are executed by steps 61–66. The steps 61–66 are subroutines for paying out coins by denomination in which superfluous coins are automatically paid out when current amounts of stored coins are larger than the initial amounts Pa–Pd of stored coins.

Figure 9:
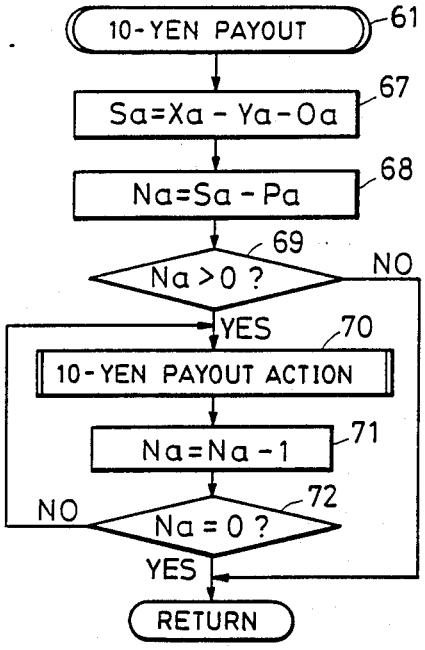

An example of the 10-yen payout subroutine in step 61 is shown in FIG. 9. In step 67, an operation Sa=Xa −Ya−Oa is executed on the basis of the deposited amount Xa, overflowing amount Ya and paid out amount Oa of 10-yen coins stored in the memories 32, 33 and 34 thereby obtaining current amount Sa of stored coins.

In next step 68, an operation Na=Sa−Pa is executed for obtaining difference Na between the current amount Sa obtained in step 67 and the initial amount Pa of stored 10-yen coins memorized in the memory 35.

In next step 69, comparison Na>0 is made so as to examine whether or not the current amount Sa is larger than the initial amount Pa. If result is YES, the processing proceeds to step 70 in which one 10-yen coin is paid out of the coin tube A. In next step 71, 1 is subtracted from Na. In step 72, whether or not Na has become 0 is examined. If result is NO, the processing returns to step 70 in which one 10-yen coin is further paid out of the coin tube A. In this manner, superfluous coins are automatically and sequentially paid out and, when the current amount Sa of stored coins in the coin tube A has coincided with the initial amount Pa, Na=0 in step 72 becomes YES and the processing returns to the main routine.

Figure 10:
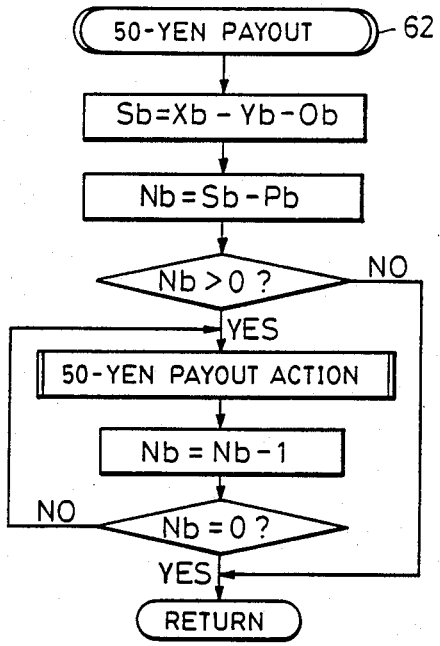
Figure 11:
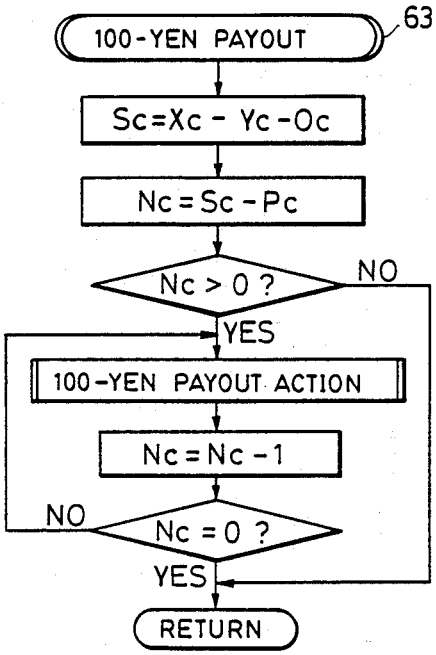
Figure 12:
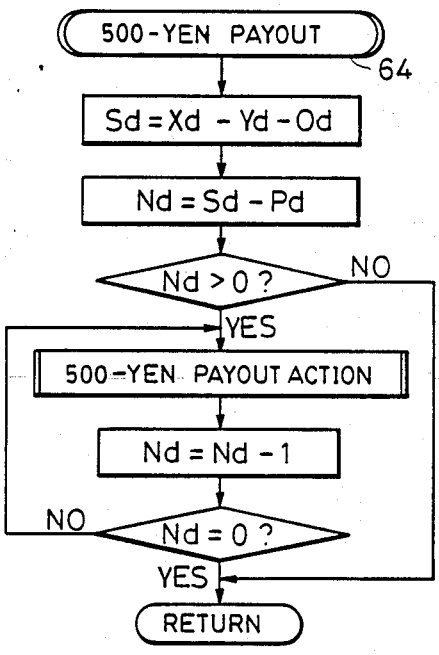

An example of the 50-yen payout subroutine in step 62 in FIG. 7 is shown in FIG. 10. An example of the 100-yen coin payout subroutine in step 63 is shown in FIG. 11. An example of the 500-yen coin payout subroutine in step 64 is shown in FIG. 12. These payout subroutines of FIGS. 10–12 are the same as the payout subroutine of FIG. 9. That is, current amounts Sb, Sc and Sd are respectively obtained on the basis of deposited amounts Xb, Xc and Xd, overflow amounts Yb, Yc and Yd, and paid-out amounts Ob, Oc and Od of corresponding denominations and superfluous coins are automatically paid out in accordance with difference Nb, Nc and Nd between these current amounts Sb, Sc and Sd and the initial amounts Pb, Pc and Pd whereby the current amounts Sb, Sc and Sd of stored coins in the coin tubes B, C and D are caused to coincide with the initial amounts Pb, Pc and Pd.

Figure 13:
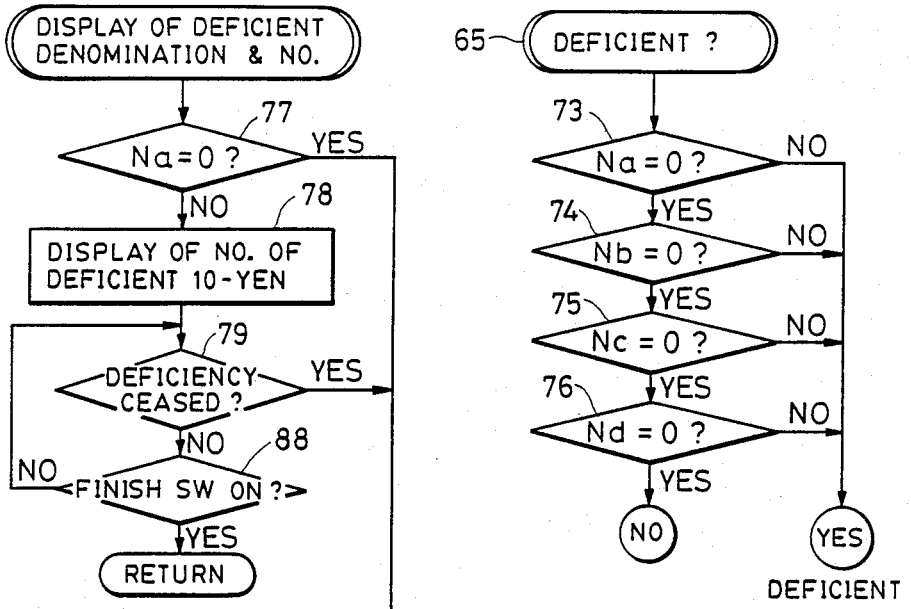

In FIG. 7, in steps 65 and 66, deficiency display processing is executed when the current amounts Sa–Sd of stored coins are smaller than the initial amounts Pa–Pd. In step 65, whether or not the current amounts Sa–Sd are smaller than the initial amounts Pa–Pd (i.e., whether or not coins are deficient) is examined. A specific example of the processing in this step 65 is shown in FIG. 13. In FIG. 13, whether or not differences Na, Nb, Nc and Nd which were obtained in the preceding step are 0 is examined (steps 73–76). As described above, when superfluous coins have been automatically paid out in the processings of the preceding steps 61–64, Na=0, Nb=0, Nc=0 and Nd=0 in the judgement made in subsequent step 65 (steps 73–76) are YES so that it is judged that no deficiency exists. If, conversely, there is deficient denomination, Na=0, Nb=0, Nc=0 and Nd=0 in the judgement in step 65 (steps 73–76) are NO.

If there is no deficiency in any denomination, the processing proceeds to step 40 in FIG. 6 in which the standby mode is brought about.

Figure 14:
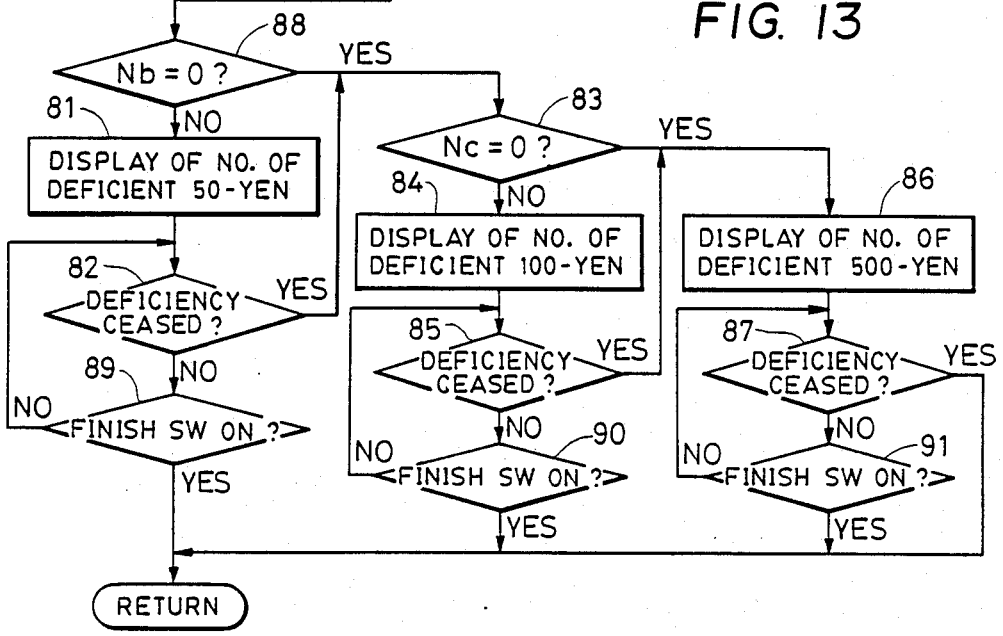

If there is deficiency in any denomination, display of deficient denomination and deficient number of coins is made in step 66. A specific example of the processing of step 77 is shown in FIG. 14. In step 77, whether or not the amount of stored 10-yen coins is deficient is examined by examining whether or not Na=0 is satisfied. If it is deficient, Na=0 is NO and the number of deficient coins (or money amount thereof) is displayed in step 78. The display of the deficient number (or money amount) is made by the display 38. In this case, the predetermined denomination and the number of deficient coins (or money amount) are indicated. Upon checking this display, the operator supplements the number of deficient coins manually. The display of the deficient number (or money amount) can be made so that the number (or money amount) decreases each time coins are supplied one by one. In step 79, whether or not the deficiency of coins has ceased is examined and, if it has ceased, the processing proceeds to step 80. By processings in steps 80–82, display of deficient denomination and deficient number of coins is likewise made with respect to next denomination (50-yen). Subsequently, the processing proceeds to step 83 and, by processing in steps 83–85, display of deficient denomination and deficient number of coins is likewise made with respect to next denomination (100-yen). Then the processing proceeds to step 86 and, by processing in steps 86 and 87, display of deficient denomination and deficient number of coins is likewise made with respect to next denomination (500-yen). In this manner, display of deficient denomination and deficient number of coins is made with respect to each denomination thereby urging the operator to supplement the deficient coin. Upon ceasing of deficiency in stored coins with respect to all denominations, the processing returns to the main routine. The operator can supplement necessary amount of coins in a simple and easy manner without mistake by watching the display of deficiency thereby enabling the amounts Sa–Sd of the respective denominations to coincide with the initial amounts Pa–Pd. The processing of displaying deficient denomination and deficient number of coins can be finished also by depressing the finish switch 30 (steps 88–91).

CLEAR MODE

Figure 15:
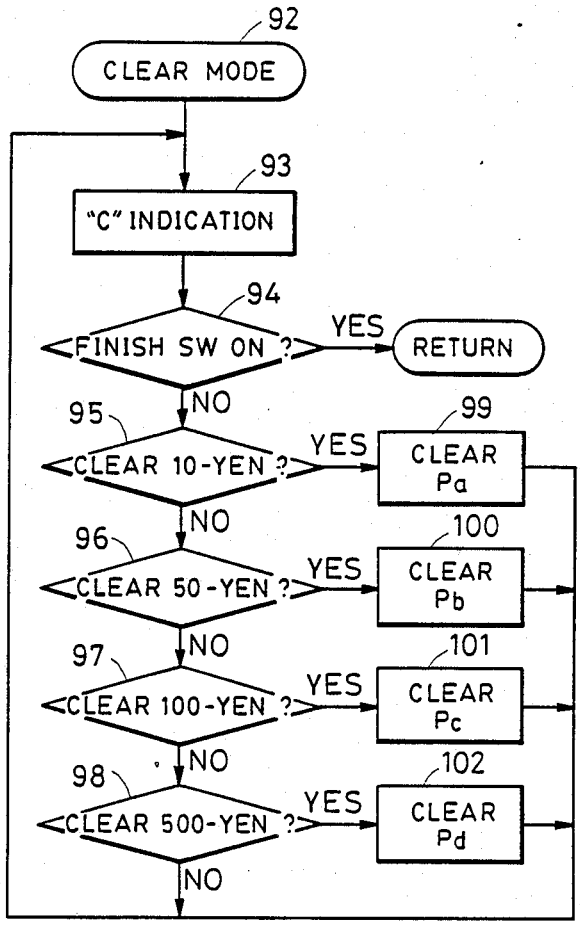

In a case where the initial amounts Pa–Pd of stored coins of respective denominations which have once been set are to be cleared, the change control mode switch 28 is depressed twice. Thereupon step 45 in FIG. 7 becomes YES and clear mode processing step 92 is executed. A specific example of the clear mode processing step 92 is shown in FIG. 15. In step 93, display of "C" is made by the display 38 for indicating the clear mode. In step 94, whether or not the finish switch 30 has been depressed is examined and which denomination is designated for clearing one of the initial amounts Pa–Pd is examined. By way of example, designation of denomination to be cleared is made by depositing a coin of that denomination. If, accordingly, the initial amount Pa of 10-yen is to be cleared, a 10-yen coin is deposited. Step 95 thereupon becomes YES. When one of steps 95–98 is YES, the processing proceeds to corresponding steps 99–102. In steps 99–102, data of corresponding initial amount in the initial amounts Pa–Pd stored in the memory 35 is cleared. At this time, all coins stored in a corresponding one of the coin tubes A, B, C and the coin retaining section D may be paid out. For finishing the clear mode, the finish switch 30 is depressed. Step 94 thereupon becomes YES and the processing returns to the main routine.

Although not illustrated, in a case where the switch 30 is not depressed for a predetermined period of time for depositing a coin for setting or clearing purpose or for finishing when "P" indication or "C" indication is made in the display 38 during the change control mode, the change control mode may be automatically finished.

In the above, embodiment, setting of the initial amounts Pa–Pd is made by deposition of a coin (FIG. 8). Alternatively, the setting may be made by employing a numerical value setting switch. In this case, coins of the initial amounts Pa–Pd which are set by the numerical value setting switch are deposited separately in the coin storing section 12.

In the above described embodiment, the display of deficiency is made by indicating the deficient number of coins. Alternatively, the mere fact of deficiency may be indicated and this indication may be cancelled when the deficiency has ceased due to supply of coins.

In the above described embodiment, accumulated deposited numbers Xa, Xb, Xc and Xd, overflow numbers Ya, Yb, Yc and Yd, and paid-out numbers Oa, Ob, Oc and Od for the respective denominations are stored in the memories 32, 33 and 34 and arithmetic operation is made in a package during the change control mode for obtaining the current amounts Sa, Sb, Sc and Sd for the respective denominations. Alternatively, an operation for obtaining constantly the current amounts Sa, Sb, Sc and Sd may be made each time a coin has entered and gone out, storing results of the operation in the RAM 31. In this case, the memories 32, 33 and 34 are unnecessary and, as the going-in-and-out detection means, a deposited coin sensor, means for detecting that a coin has been paid out (this means need not be limited to the coin sensor 15*e* but may be means for detecting, by denomination, that a coin payout command has been issued) and an overflowing coin sensor have only to be provided. In this case, detection signals of these components may be cumulatively added or subtracted with respect to the set initial amounts Pa–Pd.

It is also possible not to store the set initial amounts Pa–Pd as data. In other words, since it will suffice after all if differences Na–Nd between the current amounts Sa–Sd of stored coins and the initial amounts Pa–Pd can be obtained, coins for the initial amounts Pa–Pd are initially stored in the coin storing section 12. As the going-in-and-out detection means, a deposited coin sensor, means for detecting that a coin has been paid out (as described above, this means need not be the paid out coin sensor 15*e* but may be means for detecting that a coin payout command has been issued) and an overflowing coin sensor have only to be provided. By cumulatively adding or subtracting detection signals of these detectors, the differences Na–Nd between the current amounts Sa–Sd and the initial amounts Pa–Pd can be directly obtained. In this case, means for setting the initial amounts Pa–Pd as data is unnecessary and coins of desired initial amounts Pa–Pd of stored coins may be initially set (i.e., initially stored) in the coin storing section 12.

Various modifications may be made for obtaining the current amounts Sa–Sd of stored coins or the differences Na–Nd.

The display of deficiency need not be a visual display but it may be one stimulating hearing or other sense such as a warning sound.

The display 38 or display means need not be a volatile display such as a light-emitting diode or liquid crystal but may be a device producing a hard copy output such as a printer.

SALES MANAGEMENT FUNCTION

The function of the device as a sales management device will now be described.

Basically, the devices used for the above described devices for managing the amount of stored coins such as the deposited amount memory 32, the paid-out amount memory 33 and the overflow amount memory 34 can be utilized for sales management. Imparting of the sales management function to the above described embodiment can be realized by constructing the microcomputer 26 in such a manner that it can carry out a proper sales management program. An example of such sales management program is shown in FIGS. 16 through 19.

Figure 16:
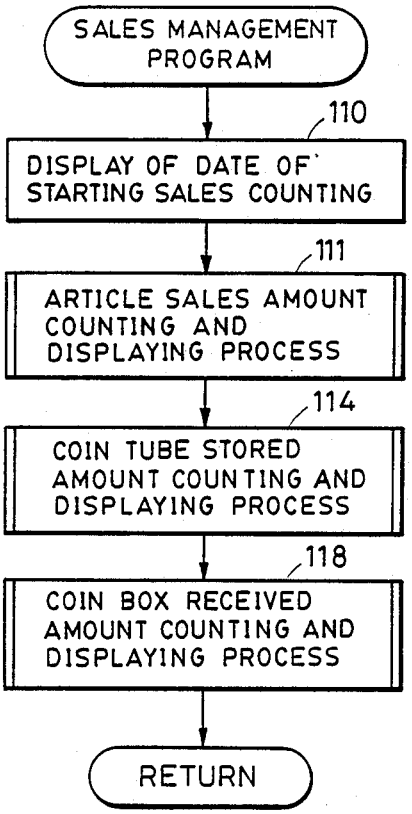

Execution of the sales management program shown in FIG. 16 can be started by inserting a step for judging whether or not a sales management mode is executed in the main routine shown in FIG. 6. For example, a sales management mode switch (not shown) operated by the operator is provided and the sales management program shown in FIG. 16 is started when this sales management mode switch is turned on. In this case, the sales management mode switch need not be a switch functioning exclusively for this purpose but may be a switch functioning concurrently for other purpose. For example, the main routine of FIG. 6 may be modified in such a manner that the sales management program will be executed when the change control switch 28 is turned on once and the change control mode routine shown in FIG. 7 will be executed when this switch 28 is turned on twice.

In the sales management program of FIG. 16, in step 110, date of starting sales counting is displayed on the display 38 for indicating a day on which calculation of sales amount to be displayed from now is started.

Figure 17:
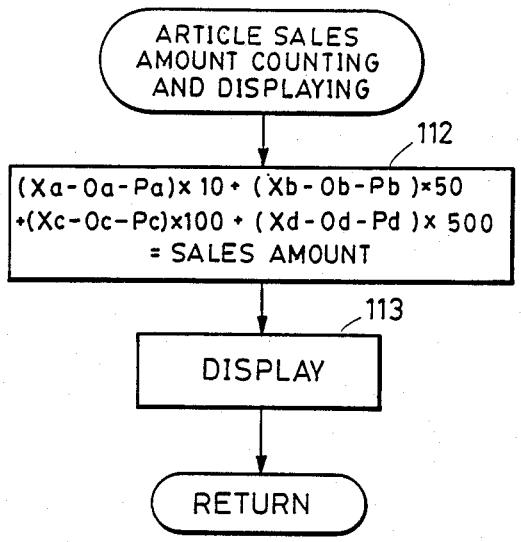

In next step 111, a processing for counting and displaying sales amount of an article is executed. An example of this article sales amount counting and displaying processing is shown in FIG. 17. In this processing, in step 112, the following operation is made in accordance with data Xa–Xd, Oa–Od and Pa–Pd stored in the deposited amount memory 32, paid-out amount memory 33 and initial amount setting data memory 35. The paid out amounts Oa, Ob, Oc and Od and the initial amounts Pa, Pb, Pc and Pd of the respective denominations are subtracted from the corresponding deposited amounts Xa, Xb, Xc and Xd of the respective denominations and results of the subtraction are multiplied with corresponding unit amounts 10, 50, 100 and 500 of the respective denominations and results of the multiplication are added together. Thus, the operation $(Xa-Oa-Pa)\times 10+(Xb-Ob-Pb)\times 50+(Xc-Oc-Pc)\times 100+(Xd-Od-Pd)\times 500$ is executed whereby sales amount which is remaining after subtracting the total paid amount from the total amount of deposited coins is obtained. Since the above equation is based on the condition that the initial amounts Pa, Pb, Pc and Pd are preset as the deposited amounts Xa, Xb, Xc and Xd, the initial amounts Pa, Pb, Pc and Pd are subtracted. If, however, the initial amounts Pa, Pb, Pc and Pd are not preset, the subtraction of Pa, Pb, Pc and Pd is unnecessary.

In next step 113, the sales amount obtained in the preceding step is displayed by the display 38.

Figure 18:
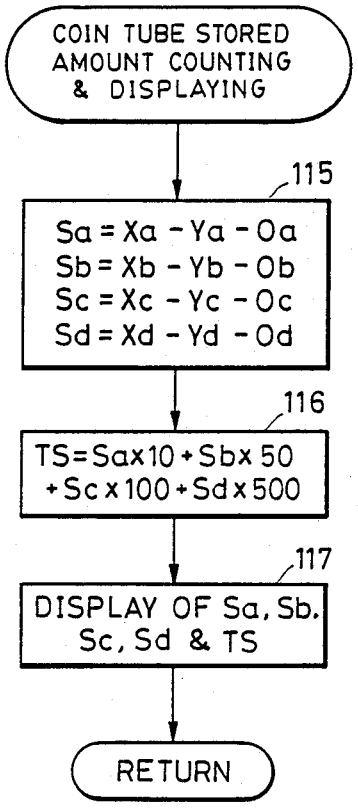

Reverting to FIG. 16, in step 114, a processing for counting and displaying the amount of stored coins in the coin tubes is executed. An example of this coin tube stored amount counting and displaying processing is shown in FIG. 18. In this processing, in step 115, the following operation is made in accordance with data Xa–Xd, Oa–Od and Ya–Yd stored in the deposited amount memory 32, paid-out amount memory 33 and overflow amount memory 34. The overflow amounts Ya, Yb, Yc and Yd of the respective denominations and the paid out amounts Oa, Ob, Oc and Od are subtracted from the corresponding deposited amounts Xa, Xb, Xc and Xd of the respective denominations and the current amounts Sa, Sb, Sc and Sd of stored coins in the coin tubes A–D are thereby obtained.

In next step 116, data of the stored amounts Sa, Sb, Sc and Sd are multiplied with unit amounts 10, 50, 100 and 500 of the respective denominations and results of the multiplication are added together for obtaining a total sum TS of the coins stored in the coin tubes A–D.

In next step 117, the current amounts Sa, Sb, Sc and Sd in the coin tubes A–D obtained in the preceding step and the total sum SM are displayed by the display 38.

Figure 19:
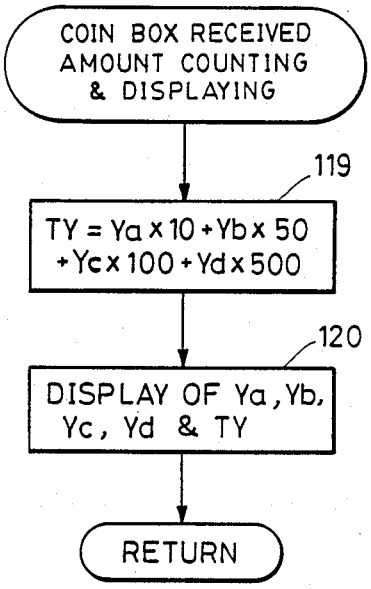

Reverting to FIG. 16, in step 118, a processing for counting and displaying the amount of coins received in the coin box is executed. An example of the coin box received amount counting and displaying processing is shown in FIG. 19. In this processing, in step 119, data of the overflow amounts Ya, Yb, Yc and Yd of the respective denominations are multiplied with corresponding unit amounts 10, 50, 100 and 500 of the respective denominations in accordance with the data stored in the overflow memory 34 and results of the multiplication are added together for obtaining a total sum TY of the coins received in the coin box 16.

In next step 120, data of the overflow amounts Ya, Yb, Yc and Yd of the respective denominations stored in the overflow memory 34, i.e., the numbers of coins by denomination received in the coin box 16, and the total sum TY of the coins received in the coin box 16 which has been obtained in the preceding step are displayed by the display 38.

In the foregoing manner, the sales amount, the current amounts Sa, Sb, Sc and Sd of stored coins in the coin tubes A–D and the total sum TY of the amounts of coins received in the coin box 16 are displayed by the display 38.

The equation for obtaining the sales amount shown in step 112 and other equations need not be ones shown in FIGS. 17 through 19 but they may be suitably modified.

The displays in steps 113, 117 and 120 need not be indications on the display 38 but may be a hard copy output by a printer or other output device.

If the sales management function only is to be realized, the above described function of the change control mode is not absolutely necessary.

As described in detail above, according to the invention, going in and out of coins with respect to a coin storing device are detected, difference between current amount of stored coins and initial amount of stored coins in the coin storing device is obtained on the basis of this detection and a superfluous coin is automatically paid out if the current amount of stored coins is larger than the initial amount whereas display of deficiency is made for urging supplement of deficient coins if the current amount of stored coins is smaller than the initial amount. As a result, the processing for storing a predetermined initial amount of coins in the coin storing device at the start of counting in the management can be performed in a simple and easy manner without mistake. Since, further, a predetermined initial amount of coins is always stored in the coin storing device at the start of counting in the management, control for counting subsequent amount of stored coins can be performed accurately and this will contribute greatly to the sales amount management in vending machines.

Further, according to the invention, the overflowing coin detection means is provided for counting coins overflowing from the coin storing device and received in the coin box by denomination and memorizing result of counting so that coins by denominations received in the coin box can be detected. Accordingly, not only amounts of stored coins in the coin storing device by denomination but also amounts of coins which have overflown from the coin storing device and have been received in the coin box are detected by denomination and a total sum of the received coins, i.e., sales amount, is detected from these amounts. Besides, the amount of received coins by denomination is readily detected so that this contributes to the sales amount management.

What is claimed is:

1. A device for managing amount of stored coins comprising:

a coin storing device for storing coins having deposited coins supplemented to stored coins and having a coin or coins among the stored coins paid out for change or other purpose;

initial stored coin amount setting means for setting an initial amount of stored coins in said coin storing device;

going-in-and-out detection means for detecting an amount of coins going in and out of said coin storing device;

operation means for obtaining difference between a current amount of stored coins in said coin storing device and the initial amount of stored coins in accordance with the output of said going-in-and-out detection means and the initial amount of stored coins;

command means for commanding a processing for causing the amount of stored coins in said coin storing device to coincide with the initial amount of stored coins;

payout control means responsive to the command issued by said command means for paying out, if the current amount of stored coins in said coin storing device is larger than the initial amount of stored coins, coins of the number corresponding to the difference obtained by said operation means; and display control means responsive to the command issued by said command means and the difference obtained by said operation means for displaying, if the current amount of stored coins in said coin storing device is smaller than the initial amount of stored coins, the fact that the amount of stored coins is deficient.

2. A device as defined in claim 1 wherein said display control means displays the difference obtained by said operation means as the number of coins which are deficient.

3. A device as defined in claim 2 wherein the displayed number of coins which are deficient in said display control means sequentially decreases each time a deposited coin is supplemented to said coin storing device upon deposition of the coin.

4. A device as defined in claim 1 wherein the displayed number of coins which are deficient in said display control means is erased when the deficiency of coins has ceased by supplementing of a deposited coin to said coin storing device upon deposition of the coin.

5. A device as defined in claim 1 wherein said initial stored coin amount setting means comprises:

mode selection means for selecting an initial stored coin amount setting mode; and memory means for storing, by denomination, the number of coins deposited in a state where the initial stored coin amount setting mode has been selected by said mode selection means as set data of the initial stored coin amount corresponding to a specific denomination.

6. A device as defined in claim 1 wherein said going-in-and-out detection means comprises:

deposited coin detection means for counting and memorizing deposited coins by denomination;

paid-out coin detection means for counting and memorizing coins paid out of said coin storing device by denomination; and overflowing coin detection means for counting and memorizing coins which have overflown from said coin storing device and received in a coin box by denomination.

7. A device as defined in claim 6 wherein said overflowing coin detection means comprises:

a coin sensor provided or each denomination in a passage leading the coins which have overflown from said coin storing device to said coin box and detecting a coin passing through said passage; and memory means for counting and memorizing a coin detection signal outputted by said coin sensor by denomination.

8. A device as defined in claim 6 wherein said operation means calculates the current amount of stored coins in said coin storing device by subtracting the amount of paid-out coins detected by said paid-out coin detection means and the amount of coins which have overflown detected by said overflowing coin detection means from the amount of deposited coins detected by said deposited coin detection means, and calculates the difference between the current amount of stored coins thus obtained and the initial amount of stored coins.

9. A device as defined in claim 1 wherein said going-in-and-out detection means comprises:

deposited coin detection means for detecting deposited coins;

coin paying out detection means for detecting that a coin has been paid out of said coin storing device; and overflowing coin detection means for detecting coins which have overflown from said coin storing device and received in a coin box.

10. A device as defined in claim 1 wherein said command means consists of an inventory switch.

11. A device as defined in claim 1 wherein said display control means displays that the stored coins are deficient by employing a money amount display device for displaying an amount of deposited coins.

12. A device for managing amount of stored coins comprising:

a coin storing device for storing coins having deposited coins supplemented to stored coins and having a coin or coins among the stored coins paid out for change or other purpose;

going-in-and-out detection means for detecting an amount of coins going in and out of said coin storing device;

operation means for obtaining difference between a current amount of stored coins in said coin storing device and an initial amount of stored coins which has been initially set in said coin storing device in accordance with the output of said going-in-and-out detection means;

command means for commanding a processing for causing the amount of stored coins in said coin storing device to coincide with the initial amount of stored coins;

payout control means responsive to the command issued by said command means for paying out, if the current amount of stored coins in said coin storing device is larger than the initial amount of stored coins, coins of the number corresponding to the difference obtained by said operation means; and display control means responsive to the command issued by said command means and the difference obtained by said operation means for displaying, if the current amount of stored coins in said coin storing device is smaller than the initial amount of stored coins, the fact that the amount of stored coins is deficient.

13. A method for managing amount of stored coins in a coin storing device for storing coins having deposited coins supplemented to stored coins and having a coin or coins among the stored coins paid out for change or other purpose comprising:

a first step for initially setting a predetermined initial amount of stored coins in said coin storing device;

a second step for detecting an amount of coins going in and out of said coin storing device;

a third step for obtaining difference between a current amount of stored coins in said coin storing device and the initial amount of stored coins in accordance with result of detection in said second step;

a fourth step for paying out, if the current amount of stored coins in said coin storing device is larger than the initial amount of stored coins, the number of coins corresponding to the difference obtained in said third step from said coin storing device thereby to cause the current amount of stored coins to coincide with the initial amount of stored coins;

a fifth step for displaying, if the current amount of stored coins in said coin storing device is smaller than the initial amount of stored coins, that the amount of stored coins is deficient in accordance with the difference obtained in said third step; and a sixth step for causing the current amount of stored coins to coincide with the initial amount of stored coins by supplementing the amount of coins which is deficient to said coin storing device in accordance with the display made in said fifth step.

14. A method as defined in claim 13 wherein processings of said respective steps are made for each denomination.

15. A sales managing device comprising:

a coin storing device for storing coins having deposited coins supplemented to stored coins and having a coin or coins among the stored coins paid out for change or other purpose;

a coin box receiving coins which have overflown from said coin storing device;

deposited coin detection means for counting and memorizing deposited cons by denomination;

paid-out coin detection means for counting and memorizing coins which have been paid out of said coin storing device by denomination;

overflowing coin detection means including a plurality of coin sensors for counting and memorizing, by denomination, coins which have overflown from said coin storing device and received in said coin box; and operation means for calculating the amount of stored coins in said coin storing device by denomination in response to outputs of said deposited coin detection means, said paid-out coin detection means and said overflowing coin detection means, the amount of stored coins in said coin storing device being detected by denomination by the output of said operation means and the current amount of coins received in said coin box being detected by denomination by the output of said overflowing coin detection means.

16. A sales managing device as defined in claim 15 which further comprises summing means for summing the amount of coins received in said coin box in response to the output of said overflowing coin detection means, a current sum of the coins in said coin box being detected by the output of said summing means.

17. A sales managing device as defined in claim 15 which further comprises display means for displaying the amount of stored coins by denomination in said coin storing device, the amount of coins by denomination received in said coin box and the sum of these amounts.

18. A sales managing device as defined in claim 15 wherein said overflowing coin detection means comprises:

a coin sensor provided for each denomination in a passage leading coins which have overflown from said coin storing device to said coin box and detecting a coin passing through said passage; and memory means for counting and memorizing a coin detection signal outputted by said coin sensor.

19. A coin mechanism comprising:

coin discrimination means for discriminating a true coin from a false one among deposited coins;

a coin storing device for storing a deposited coin which has been detected as a true coin by said coin discrimination means and paying out a coin or coins among the stored coins for change or other purpose;

payout means for paying out a coin from said coin storing device;

a coin box receiving coins which have overflown from said coin storing device;

a plurality of coin sensors, one of said coin sensors provided for each denomination in a passage leading coins which have overflown from said coin storing device to said coin box and detecting a coin passing through said passage.

20. A coin mechanism as defined in claim 19 which further comprises counting means for counting coins led to said coin box in response to the output of said overflowing coin sensor by denomination.

* * * * *